US008169447B2

(12) United States Patent
Bhogal et al.

(10) Patent No.: US 8,169,447 B2
(45) Date of Patent: May 1, 2012

(54) AUTOMATIC COLOR DISPLAY CONVERSION

(75) Inventors: Kulvir Singh Bhogal, Fort Worth, TX (US); Robert Ross Peterson, Austin, TX (US)

(73) Assignee: International Business Machines Corporation, Armonk, NY (US)

( * ) Notice: Subject to any disclaimer, the term of this patent is extended or adjusted under 35 U.S.C. 154(b) by 917 days.

(21) Appl. No.: 11/752,119

(22) Filed: May 22, 2007

(65) Prior Publication Data

US 2008/0291213 A1 Nov. 27, 2008

(51) Int. Cl.
*G09G 5/02* (2006.01)

(52) U.S. Cl. ..... 345/589; 345/596; 345/604; 345/605; 382/163; 382/169; 358/518

(58) Field of Classification Search ..... None
See application file for complete search history.

(56) References Cited

U.S. PATENT DOCUMENTS

| | | | | |
|---|---|---|---|---|
| 5,726,781 | A * | 3/1998 | Isemura et al. | 358/530 |
| 6,456,340 | B1 * | 9/2002 | Margulis | 348/745 |
| 6,977,661 | B1 * | 12/2005 | Stokes et al. | 345/589 |
| 7,023,565 | B1 * | 4/2006 | Hino | 358/1.1 |
| 7,053,909 | B2 * | 5/2006 | Funahashi | 345/602 |
| 7,312,894 | B2 * | 12/2007 | Nagae | 358/1.9 |
| 2004/0179214 | A1 * | 9/2004 | Yabe | 358/1.9 |
| 2007/0195294 | A1 * | 8/2007 | Willey et al. | 353/119 |

* cited by examiner

*Primary Examiner* — Antonio A Caschera
(74) *Attorney, Agent, or Firm* — Law Office of Jim Boice

(57) ABSTRACT

A color computer output is dynamically converted into a monochrome computer output based on a stored profile. The stored profile may be for a piece of hardware (e.g., a monochrome printer), or a user (e.g., a color-blind user).

13 Claims, 6 Drawing Sheets

AUTOMATIC COLOR DISPLAY CONVERSION

BACKGROUND OF THE INVENTION

The present disclosure relates in general to the field of computers and similar technologies, and in particular to software utilized in this field. Still more particularly, the present disclosure relates to automatically converting a color computer output to a monochrome computer output.

SUMMARY OF THE INVENTION

A computer-implementable method, system and/or computer-readable medium are utilized to dynamically convert a color computer output into a monochrome computer output based on a stored profile. The profile may be for a piece of hardware (e.g., a monochrome printer) or a user (e.g., a color-blind user).

The above, as well as additional purposes, features, and advantages of the present invention will become apparent in the following detailed written description.

BRIEF DESCRIPTION OF THE DRAWINGS

The novel features believed characteristic of the invention are set forth in the appended claims. The invention itself, however, as well as a preferred mode of use, further purposes and advantages thereof, will best be understood by reference to the following detailed description of an illustrative embodiment when read in conjunction with the accompanying drawings, where:

DETAILED DESCRIPTION OF THE PREFERRED EMBODIMENT

The present invention is described below with reference to flowchart illustrations and/or block diagrams of methods, apparatuses (systems) and computer program products according to embodiments of the invention. It will be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks.

One useful feature of computer documents is their ability to present color coded information. For example, a graph, block of text, figure, or other graphical element may be presented in color, in order to provide a clearer understanding of the information presented in the graphical element. However, such color figures are not always practical, possible or preferable. For example, a color figure cannot be displayed on a monochrome screen or printed on a monochrome printer. Attempting to display or print a color figure on a monochrome device actually makes information disappear, since a monochrome device will often display different colors in a substantially similar monochrome shade. Similarly, some end users cannot interpret or utilize a color figure. For example, a color-blind person cannot distinguish color differences in a color figure. Similarly, some end viewers, such as the United States Patent and Trademark Office, will only accept monochrome figures of inventions and/or trademarks that are submitted for patenting/registration.

Figure 1A:
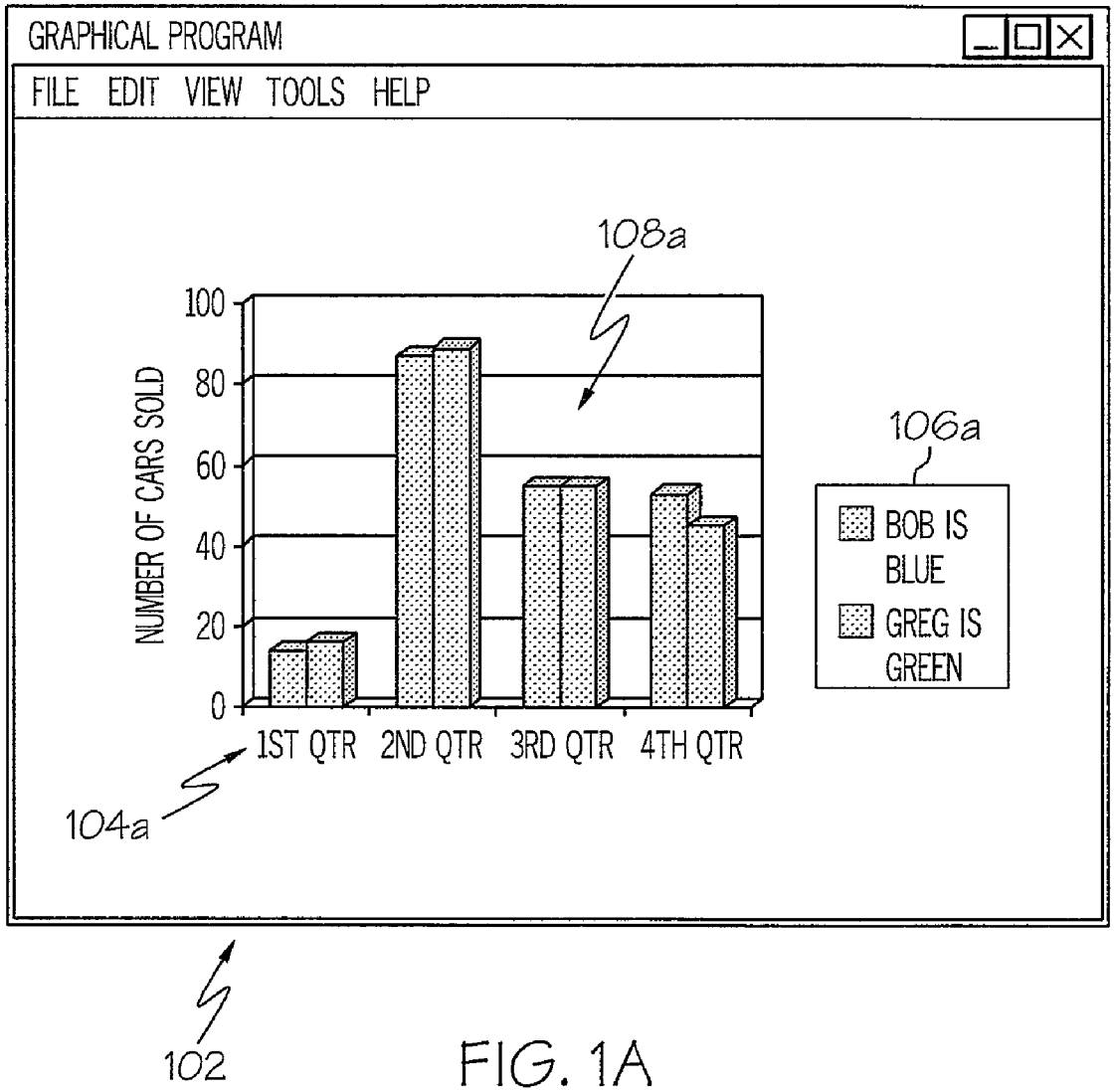
FIG. 1A depicts a color graph being displayed on a monochrome User Interface (UI)

Referring now to the figures, and in particular to FIG. 1A, a Graphical User Interface (GUI) 102 for a graphical program displays a computer output that includes multi-colored graphics. That is, as shown in exemplary fashion, the computer output is a graph 104*a*, which as suggested by legend 106*a*, has vertical bars 108*a* that were originally created in color (blue and green). However, since FIG. 1A is displayed (or printed) in monochrome, the bars appear to be a same shade of grey. This uniform shading makes it impossible to know which vertical bars 108*a* represent the number of cars sold by "Bob," and which vertical bars 108*a* represent the number of cars sold by "Greg."

Figure 1B:
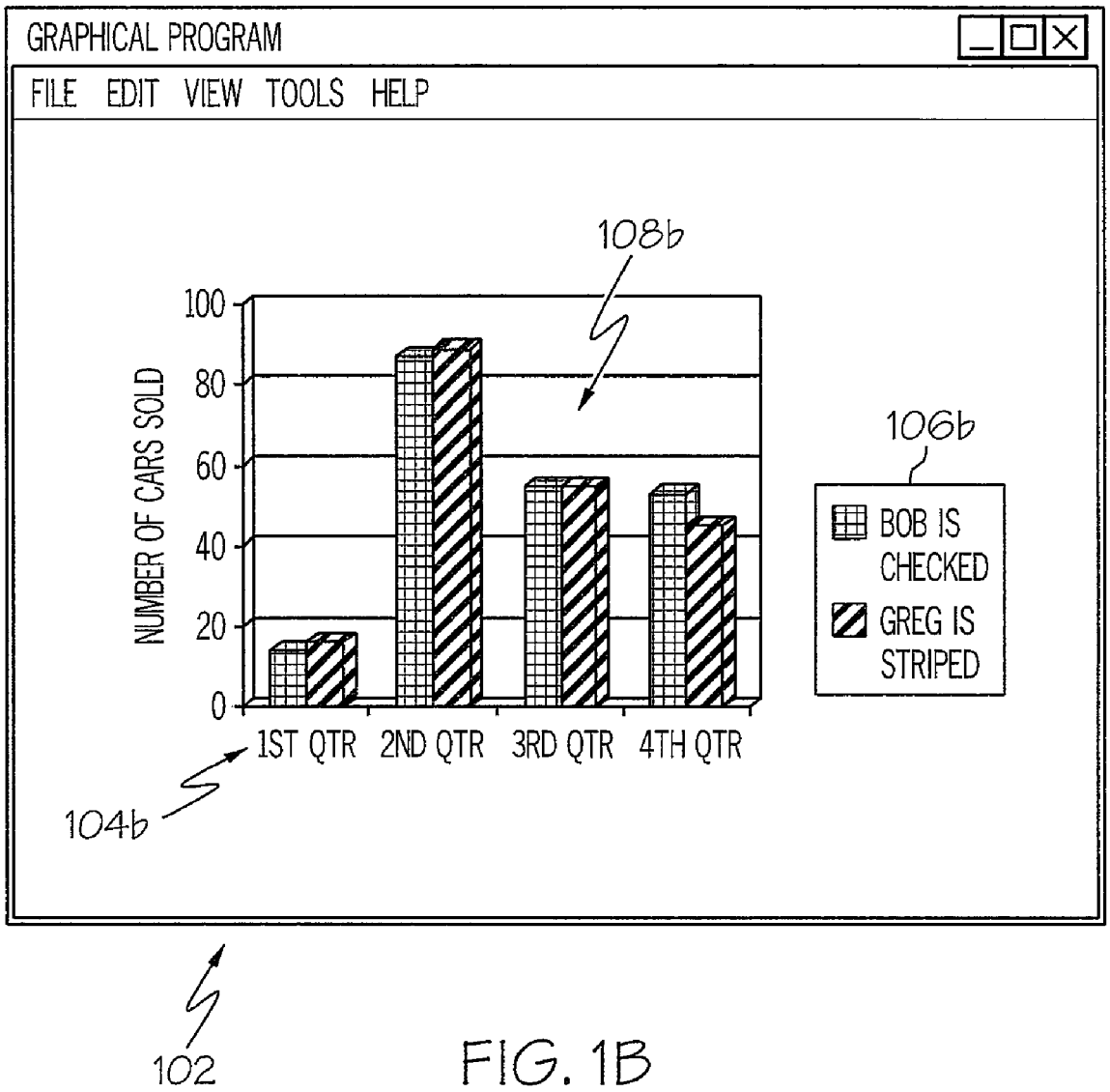
FIG. 1B depicts the graph shown in FIG. 1A after being converted into a monochrome graph.

In accordance with the method described herein, FIG. 1B shows the GUI 102 of FIG. 1A now displaying graph 104*b* in a monochrome style in which the vertical bars 108*b* are more clearly distinguishable. As suggested in the legend 106*b*, the checked vertical bars 108*b* represent the number of cars sold by "Bob," while the striped vertical bars 108*b* represent the number of cars sold by "Greg."

Figure 2:
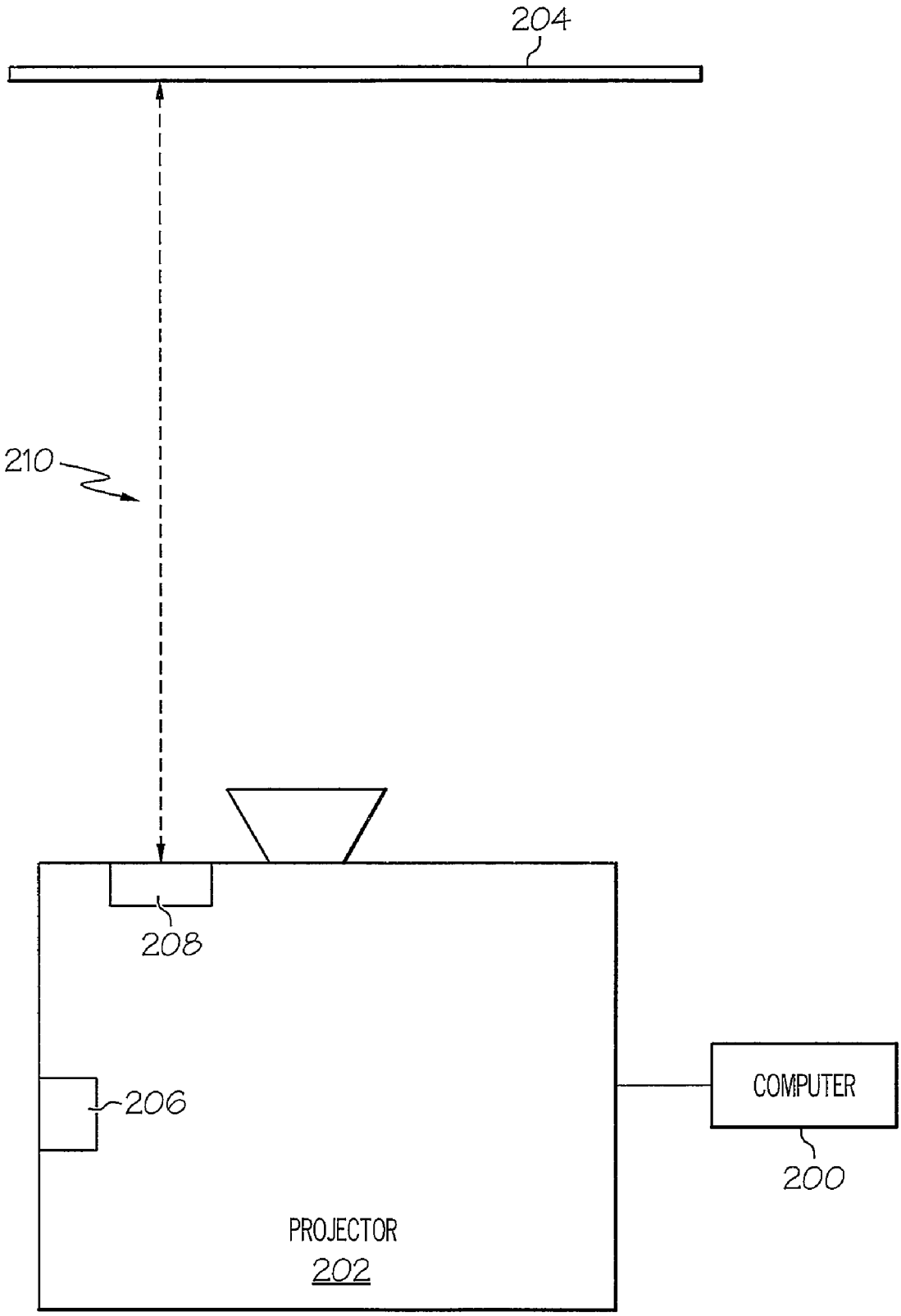
FIG. 2 illustrates a projector having a light sensor and a range finder that are used to determine whether content being sent to the projector should be converted into a monochrome format.

FIGS. 1A-B depict the need for non-color graphs when using a monochrome display or printer, or when a person viewing a graph is color-blind. FIG. 2 illustrates another situation in which a multi-colored computer output, such as a multi-colored graph, may need to be converted into a monochrome format. As shown in FIG. 2, a computer 200 may be coupled to a projector 202. Projector 202 projects images onto a projection screen 204. However, if the room is too bright, color images, particularly those found in a graph, will fade out, and will not be distinguishable. Similarly, if the projection screen 204 is too far away from the projector 202, there will be a "spread effect" that causes bars in a graph to bleed into one another, again making it difficult to see different colored bars. Thus, projector 202 is equipped with a light sensor 206 and/or a range detector 208. The light sensor 206 measures the level of ambient light, and sends these measurements to the computer 200. If the measured ambient light is too high (above a pre-determined level that has been set by a display control program in the computer), then the computer will automatically convert the computer output from colored to monochrome. Similarly, the range detector 208 measures, through any range finding technique known to those skilled in the art of range detectors (e.g., using sonar, radar, or laser signals in triangulation), a distance 210 from the projector 202 to the projection screen 204, and sends this range information to the computer 200. If the projection screen 204 is farther away from the projector 202 than a pre-determined distance set by the computer 202, then the computer will automatically convert the color computer output to a monochrome output, thus minimizing the "spread effect" described above.

Figure 3:
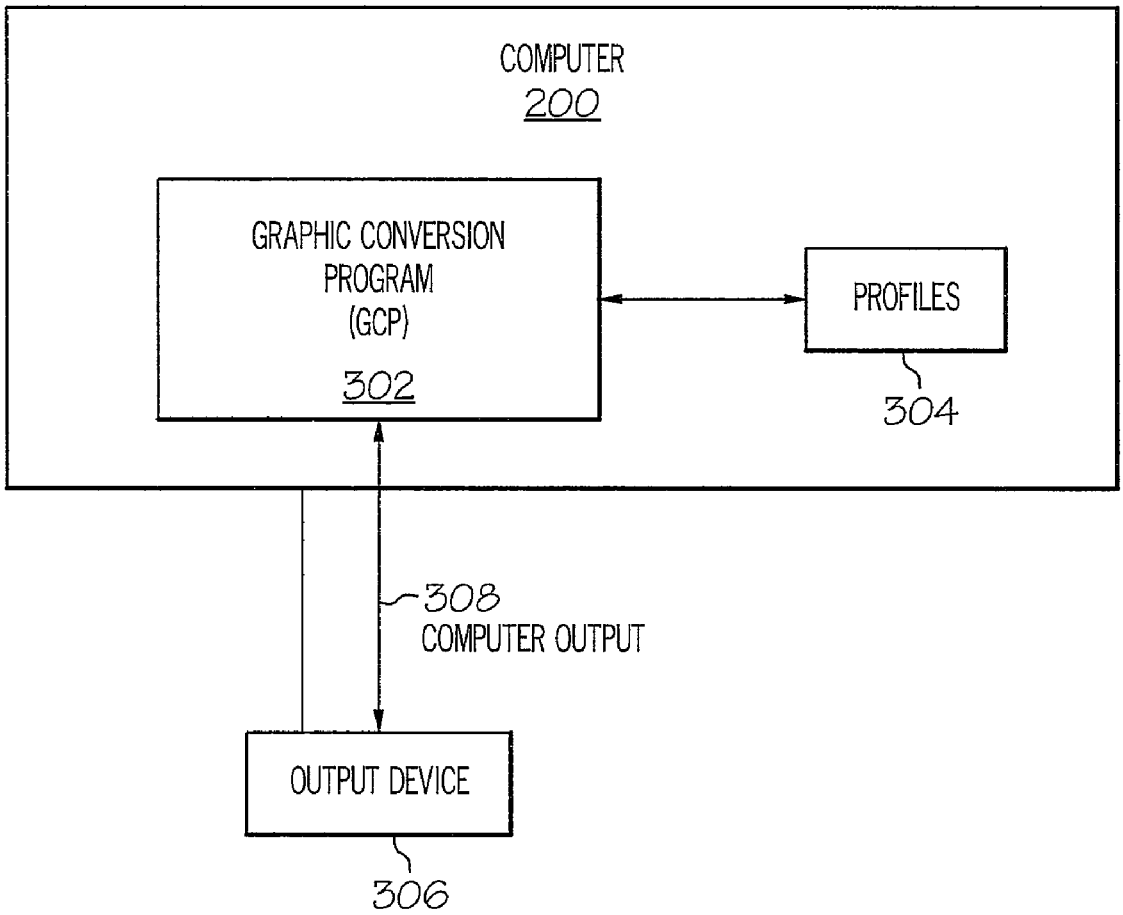
FIG. 3 depicts relationships among a graphic conversion program, profiles, and an output device.

With reference now to FIG. 3, a relationship among a Graphic Conversion Program (GCP) 302 (which automatically converts a multi-color computer output into a monochrome computer output), profiles 304, and an output device 306 is described.

Assume, for example, that the output device 306 coupled to computer 200 is a monochrome printer. By retrieving the printer's profile from profiles 304, GCP 302 will automatically convert the computer output 308 from a multi-color format to a monochrome format. GCP 302 will know what type of printer output device 306 is by any method known to those skilled in the art of port interface, Input/Output controls, etc. This type identification is then associated with a particular profile, which directs GCP 302 to convert a multi-color format to a monochrome format.

Similarly, if a profile from profiles 304 is for a projector as described in FIG. 2, GCP 302 will receive the light and/or range measurements described above, and in conjunction with information found in a profile for that particular type of projector found in profiles 304, will or will not accordingly convert a multi-color graph (or other computer output) into a monochrome graph.

Besides having profiles for hardware, profiles 304 can also store profiles for particular users or classes of users. For example, assume that GCP 302 receives a signal that a computer output is for a color-blind user, whose profile is stored in profiles 304. Using this information, GCP 302 will convert the multi-color computer output into a monochrome computer output, preferably using a monochrome fill effect that has been predetermined as optimal for the type of computer output being displayed and the visual abilities of the described user.

Similarly, profiles 304 may contain a profile for an end-receiver that requires, for legal reasons, that the computer output 308 be monochrome. For example, the United States Patent and Trademark Office (USPTO) requires that all figures for patent applications, as well as drawings of trademark logos, be monochrome to be in compliance with a governmental regulation that requires such figures to be monochrome. Thus, by informing GCP 302 that the USPTO will be the end-receiver, the computer output 308 will automatically be converted into a monochrome format. Preferably, this monochrome format includes detailed instructions regarding what shadings, fill effects, etc. are to be used.

Figure 4:
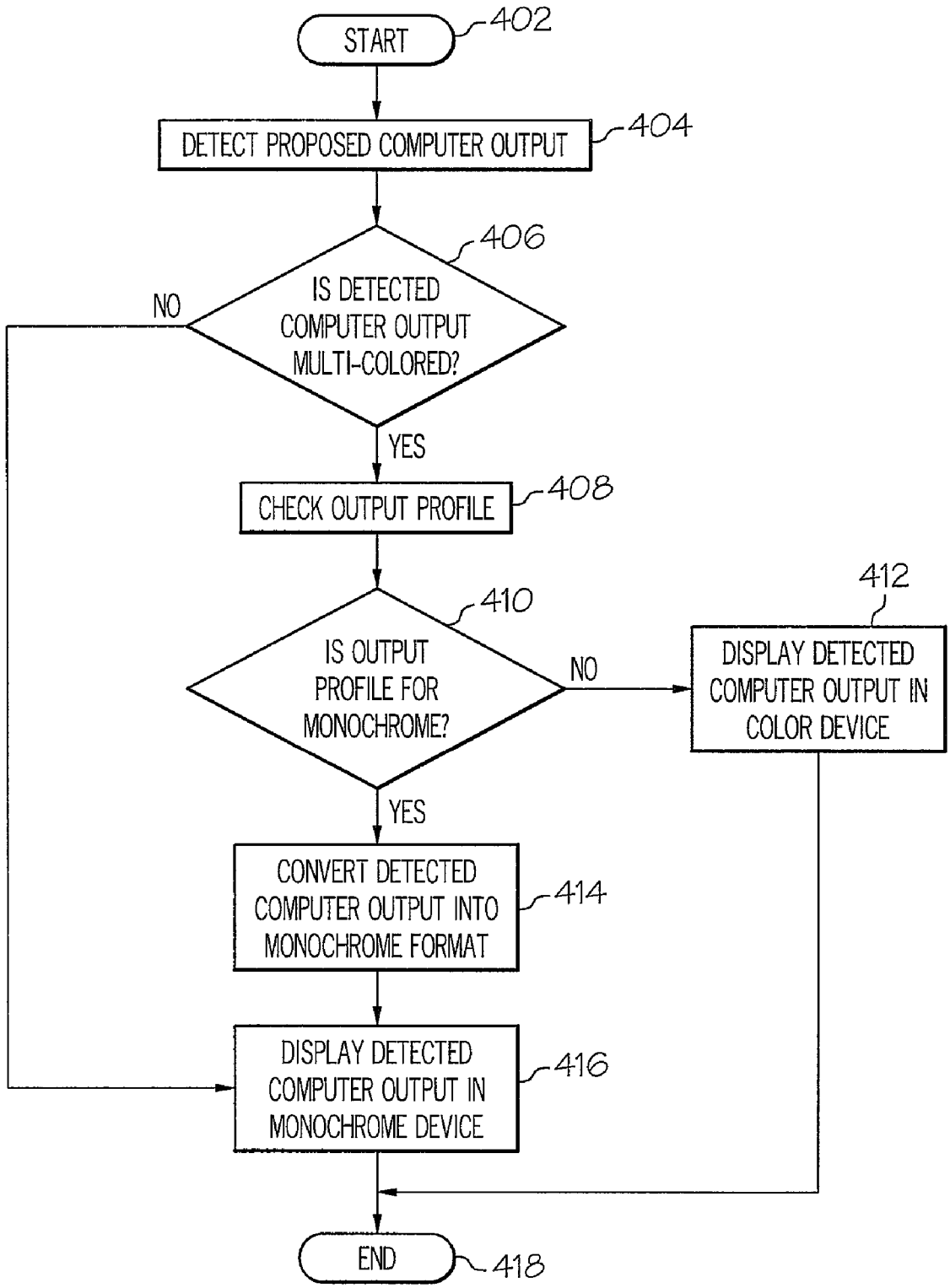
FIG. 4 is a flow-chart of exemplary steps taken to dynamically convert a color output into a monochrome output in accordance with a profile.

With reference now to FIG. 4, a flow-chart of exemplary steps taken to dynamically and automatically convert a multi-colored computer output into a monochrome computer output is presented. After initiator block 402, a proposed computer output is detected (block 404). That is, a detection is made that a computer, such as computer 200, described herein, is about to output a computer output, which may be a graph, chart, figure, text, etc. If the computer output is multi-colored (query block 406), then the profiles (e.g., profiles 304 described in FIG. 3) are checked (block 408), to determine if the multi-colored computer output needs to be converted to a monochrome format. If the profile for an output device and/or user and/or end-recipient states that the computer output should be monochrome (query block 410), then the computer output is so converted (block 414) and displayed (block 416). If the profile states that the computer output should remain multi-colored (query block 410), then the computer output is displayed in color (block 412) and the process ends (terminator block 418).

Figure 5:
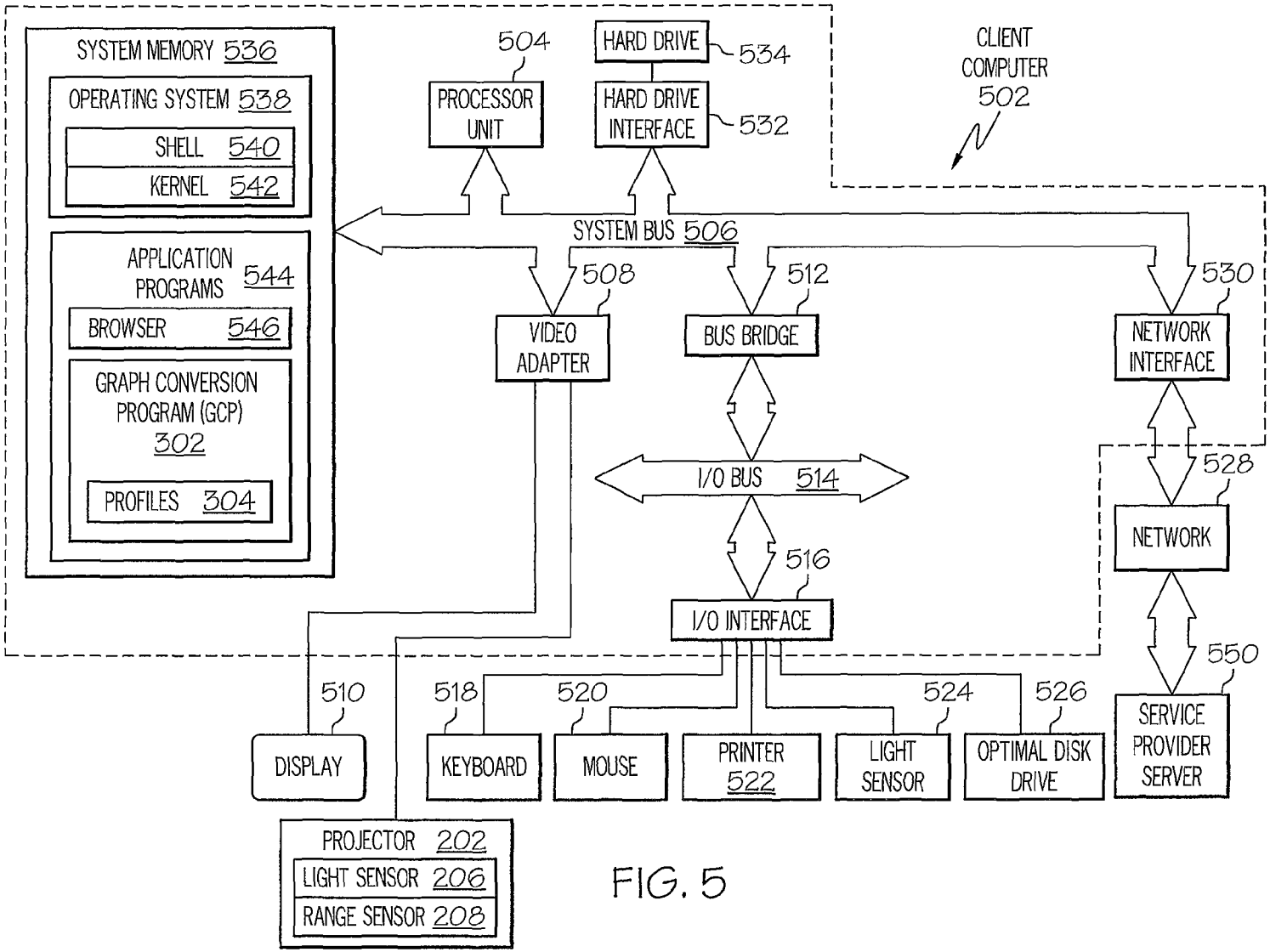
FIG. 5 depicts an exemplary computer in which the present invention may be implemented.

With reference now to FIG. 5, there is depicted a block diagram of an exemplary client computer 502, in which the present invention may be utilized. Client computer 502 includes a processor unit 504 that is coupled to a system bus 506. A video adapter 508, which drives/supports a display 510 and/or a projector 202 (which includes a light sensor 206 and/or range sensor 208 as described in FIG. 2), is also coupled to system bus 506. System bus 506 is coupled via a bus bridge 512 to an Input/Output (I/O) bus 514. An I/O interface 516 is coupled to I/O bus 514. I/O interface 516 affords communication with various I/O devices, including a keyboard 518, a mouse 520, a printer 522 (which may be a monochrome printer as described above), a light sensor 524 (which performs the same function as light sensor 206, but is a component of client computer 502), and an optimal disk drive 526. The format of the ports connected to I/O interface 516 may be any known to those skilled in the art of computer architecture, including but not limited to Universal Serial Bus (USB) ports.

Client computer 502 is able to communicate with a service provider server 550 via a network 528 using a network interface 530, which is coupled to system bus 506. Network 528 may be an external network such as the Internet, or an internal network such as an Ethernet or a Virtual Private Network (VPN). Service provider server 550 may utilize a similar architecture design as that described for client computer 502.

A hard drive interface 532 is also coupled to system bus 506. Hard drive interface 532 interfaces with a hard drive 534. In a preferred embodiment, hard drive 534 populates a system memory 536, which is also coupled to system bus 506. System memory is defined as a lowest level of volatile memory in client computer 502. This volatile memory may include additional higher levels of volatile memory (not shown), including but not limited to cache memory, registers, and buffers. Data that populates system memory 536 includes client computer 502's operating system (OS) 538 and application programs 544.

OS 538 includes a shell 540, for providing transparent user access to resources such as application programs 544. Generally, shell 540 is a program that provides an interpreter and an interface between the user and the operating system. More specifically, shell 540 executes commands that are entered into a command line user interface or from a file. Thus, shell 540 (as it is called in UNIX®), also called a command processor in Windows®, is generally the highest level of the operating system software hierarchy and serves as a command interpreter. The shell provides a system prompt, interprets commands entered by keyboard, mouse, or other user input media, and sends the interpreted command(s) to the appropriate lower levels of the operating system (e.g., a kernel 542) for processing. Note that while shell 540 is a text-based, line-oriented user interface, the present invention will equally well support other user interface modes, such as graphical, voice, gestural, etc.

As depicted, OS 538 also includes kernel 542, which includes lower levels of functionality for OS 538, including providing essential services required by other parts of OS 538 and application programs 544, including memory management, process and task management, disk management, and mouse and keyboard management.

Application programs 544 include a browser 546. Browser 546 includes program modules and instructions enabling a World Wide Web (WEE) client (i.e., client computer 502) to send and receive network messages to the Internet using HyperText Transfer Protocol (HTTP) messaging, thus enabling communication with service provider server 550.

Application programs 544 in client computer 502's system memory also include Graph Conversion Program (GCP) 302, which includes logic for implementing the steps and UI's described above in FIGS. 1A-4. Also associated with GCP 302 are profiles 304, described above in FIG. 3. In a preferred embodiment, service provider server 550 also has a copy of GCP 302, which may be executed by or downloaded from service provider server 550, as described below. In one embodiment, client computer 502 is able to download GCP 302 from service provider server 550, preferably in an "on demand" basis.

The hardware elements depicted in client computer 502 are not intended to be exhaustive, but rather are representative to highlight essential components required by the present invention. For instance, client computer 502 may include alternate memory storage devices such as magnetic cassettes, Digital Versatile Disks (DVDs), Bernoulli cartridges, and the like. These and other variations are intended to be within the spirit and scope of the present invention.

As noted above, GCP 302 can be downloaded to client computer 502 from service provider server 550. This deployment may be performed in an "on demand" basis manner, in which GCP 302 is only deployed when needed by client computer 502. Note further that, in another preferred embodiment of the present invention, service provider server 550 performs all of the functions associated with the present invention (including execution of GCP 302), thus freeing client computer 502 from using its resources. In another embodiment, process software for the method so described may be deployed to service provider server 550 by another service provider server (not shown). In yet another embodiment, GCP 302 may be implemented through the use of a browser based application such as a Rich Internet Application (RIA). This RIA may be implemented in browser 546, preferably through the use of JavaScript such as AJAX (Asynchronous JavaScript using XML).

The flowchart and block diagrams in the figures illustrate the architecture, functionality, and operation of possible implementations of systems, methods and computer program products according to various embodiments of the present invention. In this regard, each block in the flowchart or block diagrams may represent a module, segment, or portion of code, which comprises one or more executable instructions for implementing the specified logical function(s). It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

It should be understood that at least some aspects of the present invention may alternatively be implemented in a computer-useable medium that contains a program product. Programs defining functions on the present invention can be delivered to a data storage system or a computer system via a variety of signal-bearing media, which include, without limitation, non-writable storage media (e.g., CD-ROM), writable storage media (e.g., hard disk drive, read/write CD ROM, optical media), and communication media, such as computer and telephone networks including Ethernet, the Internet, wireless networks, and like network systems. It should be understood, therefore, that such signal-bearing media when carrying or encoding computer readable instructions that direct method functions in the present invention, represent alternative embodiments of the present invention. Further, it is understood that the present invention may be implemented by a system having means in the form of hardware, software, or a combination of software and hardware as described herein or their equivalent. Note that the method steps described herein may be implemented in a computer system, and may further be executed by instructions that are stored in a computer-readable medium.

In one embodiment, in which the methods described herein are performed by software that is stored on a computer-readable medium, the computer-readable medium is a component of a remote server, and the computer executable instructions are deployable to a client computer and/or a supervisory computer from the remote server. This deployment may be provided by a service provider to a customer computer (e.g., the client computer and/or the supervisory computer) on an on-demand basis.

Note that while a preferred embodiment of the present invention has been described as transforming a color document into a monochrome document, in an alternate embodiment the color document can be converted into an altered color document. For example, assume that the end user is know to be color blind to only the colors red and green, but is able to see the colors yellow and blue. In this example, the colors red and green would be replaced with the colors yellow and blue (instead of or in addition to the fill effects shown in FIG. 1B). Similarly, if projected light (as described in FIG. 3) can be easily distinguished under certain ambient light conditions (e.g., "bright") using certain colors other than what were used in the original color document, then these alternate colors are automatically utilized, instead of the monochrome fill effect described above.

Having thus described the invention of the present application in detail and by reference to preferred embodiments thereof, it will be apparent that modifications and variations are possible without departing from the scope of the invention defined in the appended claims.

What is claimed is:

1. A computer implemented method comprising:

a processor detecting a computer output from a computer, wherein the computer output includes multi-colored graphics;

retrieving a profile that describes whether the computer output needs to be in a monochrome format;

the processor converting the computer output to the monochrome format;

the processor receiving a signal indicating that the computer output is to be viewed by a color-blind user, and the processor, in response to receiving the signal indicating that the computer output is to be viewed by the color-blind user, adjusting the monochrome format of the computer output by using a monochrome fill effect that has been predetermined as being optimal for the color-blind user.

2. The computer implemented method of claim 1, wherein a monochrome output device receives the computer output.

3. The computer implemented method of claim 1, wherein the monochrome format comprises a visual pattern that is unused by the multi-colored graphics.

4. The computer implemented method of claim 3, wherein the visual pattern is selected from a group consisting of checks and stripes.

5. The computer implemented method of claim 1, further comprising:

coupling the computer to a projector, wherein the projector comprises a light sensor that measures ambient light; and in response to the light sensor detecting a light level that exceeds a pre-determined level, converting the computer output to the monochrome output for projection by the projector.

6. The computer implemented method of claim 1, further comprising:

coupling the computer to a projector, wherein the projector comprises a distance sensor that measures a distance from the projector to a projection screen; and in response to the distance sensor detecting that a distance from the projector to the projection screen exceeds a predetermined distance, converting the computer output to the monochrome output.

7. A system comprising:

a processor;

a data bus coupled to the processor;

a memory coupled to the data bus; and a computer-usable medium embodying computer program code, the computer program code comprising instructions executable by the processor and configured for:

detecting a computer output from a computer, wherein the computer output includes multi-colored graphics;

retrieving a profile that describes whether the computer output needs to be in a monochrome format;

identifying an end-receiver of the computer output as a governmental entity whose patrons are subject to a governmental regulation, wherein the governmental regulation describes required shadings and fill effects for figures that are filed with the governmental entity; and in response to identifying the computer output as figures that are to be filed with the governmental entity, automatically converting the computer output from multi-colored to the monochrome format combined with the required shadings and fill effects for figures that are filed with the governmental entity.

8. The system of claim 7, further comprising a monochrome printer output device that receives the computer output.

9. The system of claim 7, wherein the monochrome format comprises a visual pattern that is unused by the multi-colored graphics.

10. The system of claim 9, wherein the visual pattern is selected from a group consisting of checked vertical bars and striped vertical bars.

11. A non-transitory storage medium embodying computer program code, the computer program code comprising computer executable instructions configured for:

detecting a computer output from a computer, wherein the computer output includes multi-colored graphics;

retrieving a profile that describes whether the computer output needs to be in a monochrome format;

identifying an end-receiver of the computer output as a governmental entity whose patrons are subject to a governmental regulation, wherein the governmental regulation describes required shadings and fill effects for figures that are filed with the governmental entity; and in response to identifying the computer output as figures that are to be filed with the governmental entity, automatically converting the computer output from multi-colored to the monochrome format combined with the required shadings and fill effects for figures that are filed with the governmental entity.

12. The non-transitory storage medium of claim 11, wherein the computer executable instructions are deployable to a client computer from a server at a remote location.

13. The non-transitory storage medium of claim 11, wherein the computer executable instructions are provided by a service provider to a customer on an on-demand basis.

* * * * *